United States Patent [19]

Eliasson

[11] 4,352,582

[45] Oct. 5, 1982

[54] LOOSE LEAF BINDER

[76] Inventor: Erik Eliasson, Ubbås, S-332 00 Gislaved, Sweden

[21] Appl. No.: 110,754

[22] Filed: Jan. 8, 1980

[51] Int. Cl.[3] ..... B42F 13/22; B42F 13/36

[52] U.S. Cl. ..... 402/38; 402/70; 402/80 R

[58] Field of Search ..... 402/77, 76, 70, 41, 402/38, 80 P, 30–34

[56] References Cited

U.S. PATENT DOCUMENTS

| | | | |
|---|---|---|---|
| 1,618,769 | 2/1927 | Martin | 402/32 X |
| 2,135,943 | 11/1938 | Kornahrens | 402/33 X |
| 2,246,763 | 6/1941 | Schlosser | 402/76 X |
| 2,421,799 | 6/1947 | Martin | 402/77 X |
| 2,528,866 | 11/1950 | Dawson | 402/33 X |
| 2,865,377 | 12/1958 | Schroer | 402/33 |
| 2,891,553 | 6/1959 | Acton | 402/33 |
| 3,884,586 | 5/1975 | Michaelis | 402/38 |

*Primary Examiner*—Paul A. Bell
*Assistant Examiner*—John S. Brown
*Attorney, Agent, or Firm*—Cushman, Darby & Cushman

[57] ABSTRACT

A loose leaf binder for apertured loose leaves comprises a pair of hinged plastic back sections having a substantially angular cross section, and a cover pivotally connected to each of said back sections. An elongated metal plate which is rigidly secured to each of said back sections is provided with a plurality of arcuate prongs lying in planes substantially perpendicular to the hinge axis. The binder also comprises a locking member and an elongated, slidable latch member for interengagement with said locking member. Means are provided for manually displacing said latch member in its longitudinal direction between a locking position and a release position against the action of spring means for resiliently biasing the latch member towards its locking position. At least one of said arcuate prongs is secured to said metal plate nearer, and extends at a smaller radial distance from, the hinge axis of said hinged back section than the other prongs. Said one arcuated is being positioned for engagement with and abutment against an edge of said loose leaves, whereas the other arcuate prongs are positioned for passage through the apertures of the apertured loose leaves.

6 Claims, 6 Drawing Figures

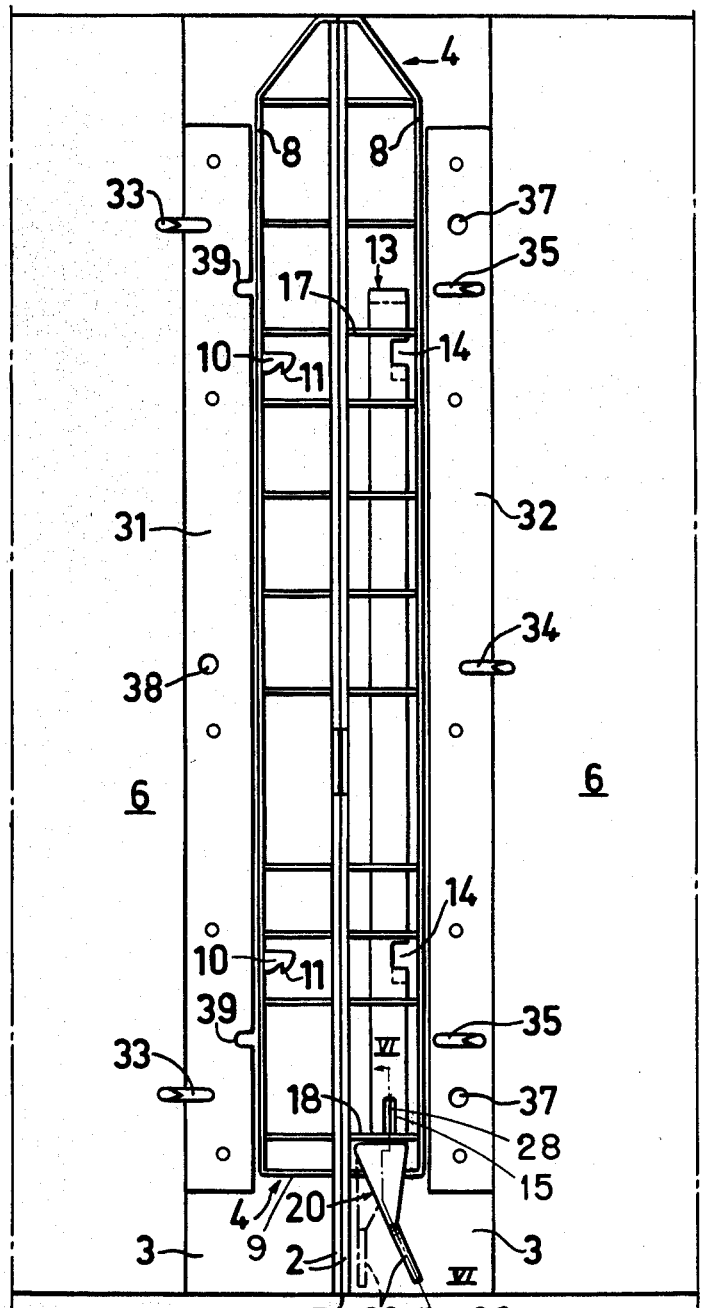
FIG.1
FIG3
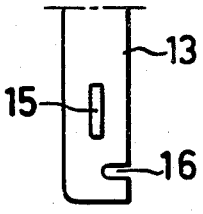
FIG.4
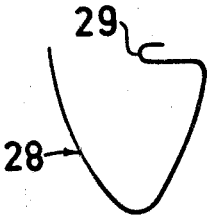
FIG.5
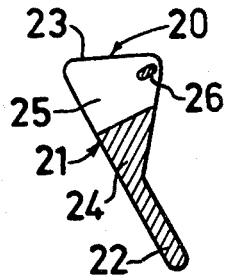
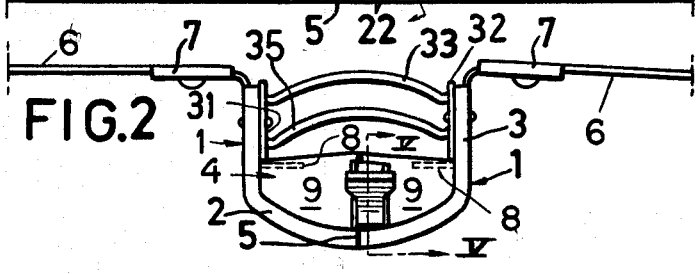
FIG.2

LOOSE LEAF BINDER

BACKGROUND OF THE INVENTION

The invention relates to loose leaf binders of the kind generally disclosed e.g. in the U.S. Pat. Nos. 2,528,866, 2,865,377 and 2,891,553.

The present binder includes a pair of hinged plastic back sections having a substantially angular cross section, a cover pivotally connected to each of said back sections, an elongated metal plate extending substantially parallel to the hinge axis of said hinged back sections and rigedly secured to each of said back sections, a plurality of arcuate prongs lying in planes substantially perpendicular to said hinge axis and rigedly secured to each of said metal plates, a locking member secured to one of said back sections and having at least one hook portion, an elongated, slidable latch member for interengagement with said locking member, means for manually displacing said latch member in its longitudinal direction between a locking position and a release position, said latch member having a notch for receiving the hook portion of the locking member when the binder is closed and the latch member is in its locking position, and means for resiliently biasing said latch member towards its locking position.

SUMMARY OF THE INVENTION

The principal object of the invention is to provide a cheap loose leaf binder which can be manufactured at extremely low costs.

This object is attained thanks to the fact that at least one of said arcuate prongs is secured to said metal plate nearer, and extends at a smaller radial distance from, the hinge axis of said hinged back sections than the other prongs, said one arcuated prong being positioned for engagement with and abutment against an edge of said loose leaves, and said other arcuate prongs being positioned for passage through the apertures of said apertured loose leaves.

According to another aspect the loose leaf binder also includes a reinforcing lattice comprising at least one longitudinal wall substantially parallel to said hinge axis and a plurality of transverse walls substantially perpendicular thereto, said lattice being at least partly of plastic and integrally united with each of said back sections. In this embodiment said biasing means is a hairpin spring having one of its shanks in engagement with an elongated opening in one end of said latch member and its other shank in engagement with one side of one of the transverse walls of said lattice, and said latch member displacing means comprises a pivotable bell crank key having a manually operable lever arm and its other lever arm extending along, and abutting, the opposite side of the lastmentioned transverse wall of the lattice, said displacing means also having a pin member in engagement with a recess in said one end of said latch member.

BRIEF DESCRIPTION OF THE DRAWINGS

Further features and advantages of the invention will become apparent from the accompanying drawings which illustrate two preferred embodiments and in which:

FIG. 1 is a fragmentary plan view of the back sections and adjacent portions of the covers representing the binder assembly in a layed open, unlocked condition;

FIG. 2 is an end view corresponding to FIG. 1 and representing the binder in the locked position;

FIG. 3 is a fragmentary plan view on a larger scale of the lower end of a latch member shown in FIG. 1;

FIG. 4 is a side view of a hairpin spring associated with the latch member;

FIG. 5 is a longitudinal sectional view substantially on line V—V in FIG. 2 through a key, also associated with the latch member.

DESCRIPTION OF THE PREFERRED EMBODIMENTS

Figure 6:
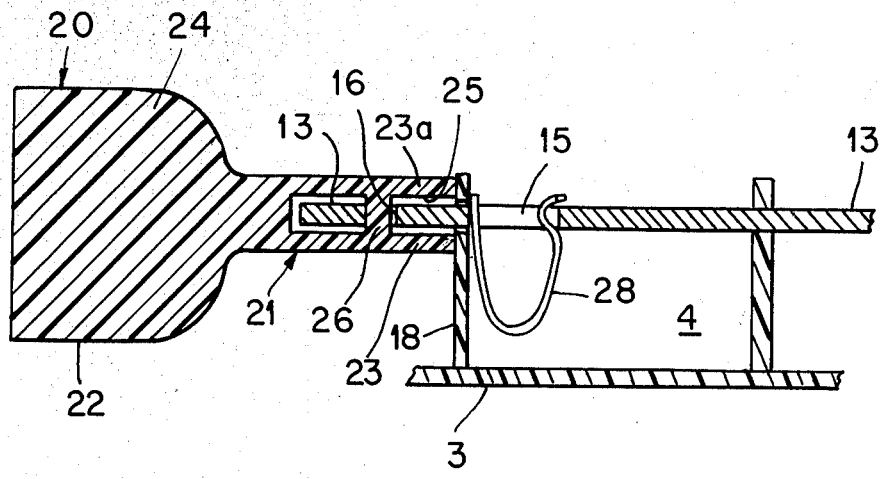
FIG. 6 is a simplified longitudinal sectional view on line VI—VI in FIG. 1.

As is evident from the drawings, the loose leaf binder according to the invention comprises two back sections which are substantially angular in cross section and are each generally designated 1. They are made of plastic, at least substantially in their entirety, and are integral with each other. Each back section comprises a central flange 2 and a lateral flange 3 which is substantially perpendicular to the flange 2. The back sections are united along a central, longitudinal, thinned hinge axis 5 and are each pivotally connected to a respective cover 6. The covers 6 are preferably riveted to a hinged marginal portion 7 of the respective back section 1.

Each back section comprises a reinforcing lattice which is generally designated 4 and is comprised of a upstanding longitudinal wall 8 and a plurality of transverse crosswalls. The two lattices 4 are preferably molded in one piece of a suitable plastic together with the two back sections 1. The longitudinal walls 8 of the lattices are substantially perpendicular to the lateral flange 3 of its angular back section 1 and substantially parallel to the central flange 2, whereas the transverse walls are substantially perpendicular to the flange 2 as well as to the flange 3 as is evidient from FIG. 1. The transverse end wall of the lattice is designated 9 in FIGS. 1 and 2.

One of the two back sections 1 is provided with at least one stationary (two in the illustrated exemplificatory embodiment) arcuate locking member 10. Each locking member is located substantially in a plane, which is perpendicular to the hinge axis 5, and extends along a circular arc having its center substantially on the hinge axis 5. Each locking member has a hook portion 11 projecting in the direction of the hinge axis 5.

The other one of the two back sections is provided with a latch member which is generally designated 13 and is adapted to cooperate with the locking members 10. The latch member 13 is comprised of a flat, elongated piece of strip metal and is provided with a notch 14 just opposite each locking member 10. In addition hereto, as shown in FIG. 3 the lower end (as seen in FIG. 1) of the latch member 13 is provided with an elongated, narrow slot 15 and with a recess or notch 16 in one of its longitudinal edges. The latch member 13, which is slidable in the direction of the hinge axis 5, passes through, and is guided by, narrow slots (not shown) in two transverse walls 17, 18 of the appurtenant lattice 4. The latch member also passes through corresponding slots in the intermediate transverse walls, as indicated in FIG. 1, or alternatively passes over said intermediate transverse walls which, of course, have to be lower than the outer transverse walls 17, 18 in this instance.

Associated with the latch member 13 is a key which is generally designated 20 and cooperates with the lower end of the latch member (as seen in FIG. 1) and the transverse wall 18. The key 20 is molded in one piece of a suitable plastic and is comprised of an inner portion 21 which is substantially triangular in plan view, as is evident from FIG. 1, and a flat, outer finger-piece 22. The inner portion 21 may be considered to be comprised of two flat, parallel and spaced triangular plates 23 and 23*a* which are united with each other by a bridge member 24 in the region of the outer corner of the triangle from which the finger-piece 22 projects, as is evident from FIG. 5 which is a simplified cross sectional view substantially on line V—V in FIG. 2. As is also evident from FIG. 5 there is an interspace 25 between the plates 23 adjacent to the transverse wall 18. This interspace is bridged by a pin member 26 interconnecting the free, inner (wider) portions of the plates 23 and being made integral therewith. This pin member is adapted to engage the notch 16 of the slidable latch member 13 (FIG. 3). As is evident from a comparison between FIG. 5 and FIG. 6 which is a partially sectional side view substantially on line VI—VI in FIG. 1, the plane of the inner plate portion 21 and that of the finger-piece 22 of the key 20 are substantially perpendicular to each other.

The key 20 constitutes a bell crank having a first lever arm which is constituted by the inner edge of the triangular portion 21, and a second lever arm which is formed of the longer side of the triangular portion 21 and the registering finger-piece 22. The pivot axis of the bell-crank key 20 is constituted by the left-hand corner (FIG. 1) pf apex of triangular portion 21, which pivots against wall 18 upon clockwise pressure on finger-piece 22. Rotation clockwise in FIG. 1 of the key around this pivot axis to the position indicated in dash-dot lines pulls the latch member 13 downwards in FIG. 1 thanks to the inter-engagement between the pin member 26 and the notch 16. This downward movement, which is resisted by a hairpin spring 28 (FIG. 4) biasing the latch member upwards in FIG. 1 towards its locking position in which the notch 14 is engaged by the hook portion 11 of the locking member 10 results in the freeing of the hooks 11 from their engagement with the latch member 13. This hairpin spring 28 is inserted in the elongated slot 15 of the latch member 13 and has one of its shanks, which suitably has an arcuate end 29, as shown in FIGS. 4 and 6, in engagement with the inner end of the slot 15, whereas the other shank of the spring engages, or abuts against, the transverse wall 18 of the lattice 4. The central, arcuate portion of the hairpin spring 28 may be located intermediate, and guided by, two elongated, parallel ridges (not shown) projecting from the inside of the lateral flange 3 of the back section 1.

Secured, e.g. by means of rivets, to said lateral flanges 3 are elongated metal plates 31 and 32, respectively. The plate 31 is provided with two arcuate (metal) prongs 33, which are intended to pass through the apertures of the loose leaves to be inserted in the binder and are located in planes substantially perpendicular to the hinge axis 5. The metal plate 32 is provided with one central arcuate (metal) prong 34, which is intended to pass through the apertures of the apertured loose leaves to be inserted in the binder and with two lateral arcuate (metal) prongs 35, which are intended as supporting guides for the inner edge of the apertured loose leaves to be inserted in the binder. The prongs 34 and 35 are also located in planes perpendicular to the hinge axis 5.

The plate 32 is provided with two apertures 37 adapted to receive the free ends of the prongs 33, when the binder is in its closed position. The plate 31 is provided with one aperture 38 corresponding to the aperture 37 and with recesses 39 adapted to receive the free ends of the prongs 35.

As is evident from the above, an important feature of the invention resides therein, that the loose leaf edge guiding prongs 35 in their entirety are located at a smaller radial distance from the pivot axis 5 than are the prongs 33 and 34.

The embodiments described above and illustrated in the drawings are, of course, to be regarded merely as non-limiting examples and may as to their details be modified in several ways within the scope of the following claims. In particular, the pattern of the lattice and the number of arcuate prongs may be varied. Furthermore, the arcuate prongs 35 may have a substantially rectangular cross section, the longitudinal direction of which is parallel to the marginal edge of the loose leaves to be supported, instead of a substantially circular cross section.

What I claim is:

1. A loose leaf binder for apertured loose leaves including:

a pair of hinged plastic back sections having a substantially angular cross section;

a cover pivotally connected to each of said back sections;

an elongated metal plate extending substantially parallel to the hinge axis of said hinged back sections and rigidly secured to each of said back sections;

a plurality of arcuate prongs lying in planes substantially perpendicular to said hinge axis, and rigidly secured to each of said metal plates;

a locking member secured to one of said back sections and having at least one hook portion;

an elongated, slidable latch member for interengagement with said locking member;

means for manually displacing said latch member in its longitudinal direction between a locking position and a release position, said latch member having a notch for receiving the hook portion of the locking member when the binder is closed and the latch member is in its locking position; and means for resiliently biasing said latch member towards its locking position, wherein at least one of said arcuate prongs is secured to said metal plates nearer, and extends at a smaller radial distance from, the hinge axis of said hinged back sections than others of said prongs and is positioned for engagement with and abutment against an edge of said loose leaves, said other arcuate prongs being positioned for passage through the apertures of said apertured loose leaves, wherein a reinforcing lattice, which at least partly consists of plastic and comprises at least one longitudinal wall substantially parallel to said hinge axis and a plurality of transverse walls substantially perpendicular thereto, is united with each of said back sections, and wherein said locking member extends substantially perpendicular to said hinge axis and has its hook portion projecting substantially in the direction of said hinge axis, and wherein said elongated latch member extends substantially parallel to said hinge axis and passes through slots provided in the transverse walls of the lattice of the other back sections.

2. A loose leaf binder including a pair of hinged plastic back sections having substantially angular cross section; a cover pivotally connected to each of said back sections; an elongated metal plate extending substantially parallel to the hinge axis of said hinged back sections and rigidly secured to each of said back sections; at least one arcuate prong extending substantially perpendicular to said hinge axis and rigidly secured to each of said metal plates; a reinforcing lattice comprising at least one longitudinal wall substantially parallel to said hinge axis and a plurality of transverse walls substantially perpendicular thereto, said lattice being at least partly of plastic and integrally united with each of said back sections; an arcuate locking member secured to one of said back sections and lying in a plane substantially perpendicular to said hinge axis and having at least one hook portion projecting substantially in the direction of said hinge axis; a flat, elongated, slidable latch member extending substantially parallel to said hinge axis and passing through slots provided in the transverse walls of the lattice of the other back section; means for manually displacing said latch member in its longitudinal direction between a locking position and a release position, said latch member having a notch for receiving the hook portion of the locking member when the binder is closed and the latch member is in its locking position; and means for resiliently biasing said latch member towards its locking position, wherein said biasing means is a hairpin spring having one of its shanks in engagement with an elongated opening in one end of said latch member and its other shank in engagement with one side of one of the transverse walls of said lattice, and said latch member displacing means comprise a pivotable bell crank key having a manually operable lever arm and its other lever arm extending along, and abutting, the opposite side of the lastmentioned transverse wall of the lattice, said displacing means also having a pin member in engagement with a recess in said one end of said latch member.

3. A binder according to claim 1, wherein said biasing means in a hairpin spring having one of its shanks in engagement with an elongated opening in one end of said latch member and its other shank in engagement with one side of one of the transverse walls of said lattice, said latch member displacing means comprise a pivotable bell crank key having a manually operable lever arm and its other lever arm extending along, and abutting, the opposite side of the lastmentioned transverse wall of the lattice, said displacing means also having a pin member in engagement with a recess in said one end of said latch member.

4. A binder according to claim 2, wherein said pivotable key comprises two flat, substantially parallel, triangular, spaced plate portions which are united with each other adjacent one of their corners and interconnected by means of said pin member, which is located near that corner of the triangular plate portions which is remote from and opposite to said transverse wall of the lattice, and a flat finger piece which is united with said corner of the triangular plate portions, said finger piece extending in a plane which is substantially perpendicular to that of each of said triangular plate portions.

5. A binder according to claim 1,2,3 or 4 wherein the prongs secured nearer the hinge axis than the other prongs are two in number and are each located near a respective end of said metal plate.

6. A binder according to claim 2 or 4 comprising:

a plurality of arcuate prongs, including said one arcuate prong, extending substantially perpendicular to said hinge axis and being rigidly secured to each of said metal plates, at least said one arcuate prong being secured to said metal plates nearer to and at a smaller radial distance from the said hinge axis than others of said prongs and being positioned for an abutting engagement with an edge of said loose leaves, said other arcuate prongs being positioned for passage through the apertures of said loose leaves.

* * * * *